United States Patent [19]

Negi et al.

[11] 4,248,991

[45] Feb. 3, 1981

[54] ELASTIC STRAPPING BAND AND METHOD FOR PRODUCING SAME

[75] Inventors: Youji Negi, Oogaki; Kouji Iwata; Kazuhiko Sakai, both of Gifu, all of Japan

[73] Assignee: Ube-Nitto Kasei Co., Ltd., Tokyo, Japan

[21] Appl. No.: 940,889

[22] Filed: Sep. 11, 1978

[30] Foreign Application Priority Data

Sep. 10, 1977 [JP] Japan ..... 52/108347

[51] Int. Cl.[3] ..... C08F 210/02; C08F 218/08

[52] U.S. Cl. ..... 526/331; 264/210.1

[58] Field of Search ..... 526/331

[56] References Cited

U.S. PATENT DOCUMENTS

| | | | |
|---|---|---|---|
| 2,947,735 | 8/1960 | Bartl | 526/331 |
| 3,244,680 | 4/1966 | Holladay et al. | 526/331 |

*Primary Examiner*—Harry Wong, Jr.

*Attorney, Agent, or Firm*—Wenderoth, Lind & Ponack

[57] ABSTRACT

An elastic strapping band is essentially made of ethylene-vinyl acetate copolymer containing vinyl acetate in the range of 3 to 20 wt %. The band has molecular orientation in the lengthwise direction thereof with a double refraction rate ($\Delta n$) being in the range of $24\times10^{-3}$ to $38\times10^{-3}$. The band has a tensile strength higher than 3.3 kg/mm$^2$, a stress residual rate higher than 15% after elongating the band under an initial load of 3.3 kg/mm$^2$, and an elasticity recovering rate higher than 70%.

2 Claims, 4 Drawing Figures

ELASTIC STRAPPING BAND AND METHOD FOR PRODUCING SAME

BACKGROUND OF THE INVENTION

This invention relates to a strapping band and method for producing same, which can maintain elastic binding force for a long period of time after it has been wound around an article or articles under stretched condition.

In many cases for binding articles by a strapping band, it is desired that the band has a relatively high elasticity and elongation rather than a high tensile strength. Because, an elastic binding force of the band is maintained for a long period of time by the residual stress thereof so that a constant contractive force is applied to the articles wound by the band.

In the event that a plurality of rigid articles such as glass bottles, pipes, tiles, bricks or the like are bound together by a strapping band which has no substantial elasticity, the binding force cannot be maintained since the contractive binding force cannot be applied to the articles by the band.

Further, in the practical binding operation, after winding the band around the article under tension, a heat plate is inserted into a space between the article and the band to join the band together by fusion thereof. Then, the heat plate is removed after fusion of the band. Accordingly, if the band has no substantial elasticity, the tension having been applied to the band at the time of winding will be lost due to the space for the heat plate.

In addition, when a plurality of articles are bound together by a strapping band, the articles tend to become more closely associated with each other by vibration applied thereto. Accordingly, when a strapping band not having a substantial elasticity is used for binding rigid articles, the band will be slackened after the articles have been subjected to vibration. Thus, the binding force having been applied to the articles will be lost.

Conventional plastic strapping bands are made of polypropylene, nylon or other thermoplastic high polymeric material having high crystallinity. Such a high polymeric material is highly elongated in the production process to orient the molecules in the lengthwise direction. The plastic strapping band of this kind has a high tensile strength in the range of about 20–40 kg/mm$^2$ and high Young's modulus in the range of about 200–700 kg/mm$^2$ but low elongation percentage of less than about 25%. Accordingly to such a known strapping band, even when the band is stretched under high tension around rigid articles and joined with each other at both ends thereof, the elongation of the band is very small and the residual stress in the band will be eliminated after a slight amount of contraction of the band.

In a practical example of a known polypropylene strapping band having a width of about 15.5 mm (40,000 denier), the band elongates only few percent when wound around articles at a binding force of 50 kg. After binding the articles, if the band contracts for about 2–3% in length from the elongated state, the residual stress in the band is almost eliminated.

As a material having a comparatively small Young's modulus and high elongation as well as high elasticity, rubber is duly considered. However, the rubber material requires vulcanization during formation into a strapping band, thus exhibiting poor productivity in a continuous production process of the strapping band.

SUMMARY OF THE INVENTION

An object of the present invention is to provide a thermoplastic strapping band having high elasticity and high residual stress in addition to a desired tensile strength.

Another object of the present invention is to provide an elastic strapping band hardly splittable along the longitudinal direction thereof.

Another object of the present invention is to provide a method for producing the strapping band of the nature set forth above.

According to one aspect of the present invention, there is provided a strapping band essentially made of ethylene-vinyl acetate copolymer containing vinyl acetate in the range of 3 to 20wt%. The band has molecular orientation in the lengthwise direction thereof with a double refraction rate ($\Delta n$) being in the range of $24\times10^{-3}$ to $38\times10^{-3}$. The band has a tensile strength higher than 3.3 kg/mm$^2$, a stress residual rate higher than 15% after elongating the band under an initial load of 3.3 kg/mm$^2$, and an elasticity recovering rate higher than 70%.

According to another aspect of the invention, there is provided a method for producing a strapping band comprising the steps of melting ethylene-vinyl acetate copolymer containing vinyl acetate in a range of from 3 to 20wt% at a temperature ranging from 150° to 200° C., extruding the molten copolymer into a band-shape, leading the band-shaped copolymer into a water bath to cool and solidify it, and subjecting the cooled band-shaped copolymer to an elongation in a multiplication range of 2.5 to 6 times of the initial length thereof, thereby providing a strapping band having a double refraction rate ($\Delta n$) in a range of from $24\times10^{-3}$ to $38\times10^{-3}$.

The invention will be better understood from the following detailed description of the invention with reference to accompanying drawings and tables.

DETAILED DESCRIPTION OF THE INVENTION

Figure 1:
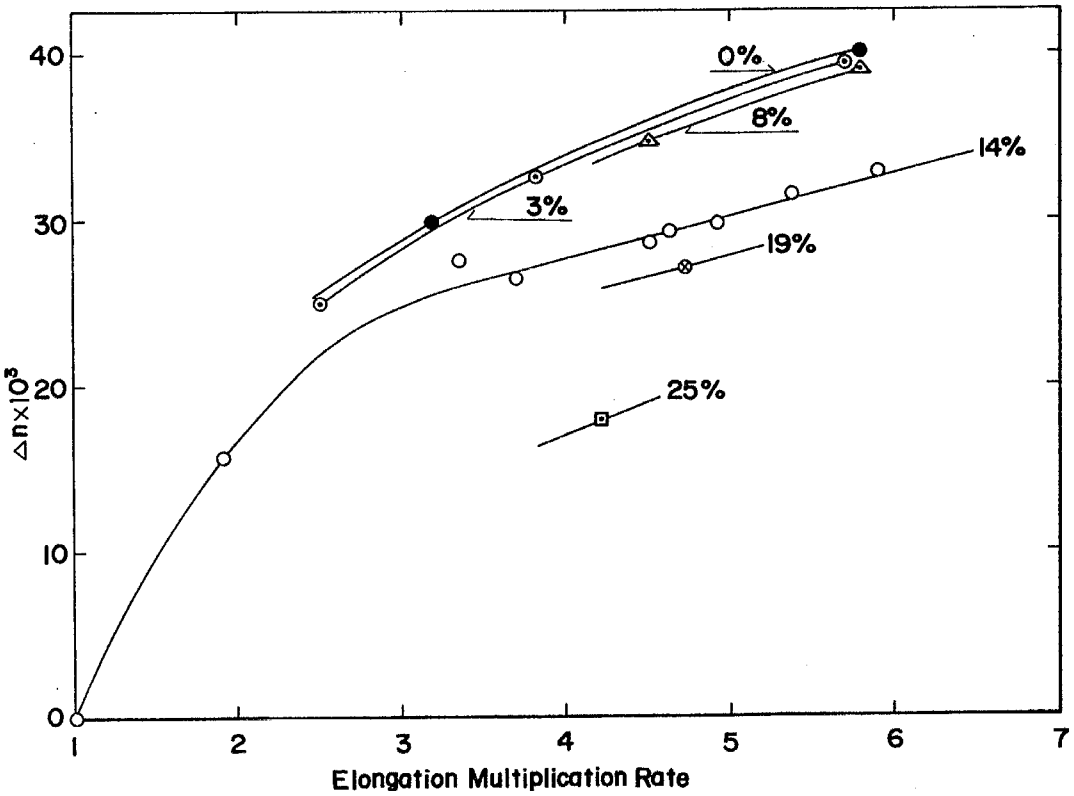
FIG. 1 is a graphical representation showing relations between double refraction rate and elongation multiplication rate of strapping band made of ethylene-vinyl acetate copolymer containing vinyl acetate of different percentages.

For obtaining an elastic strapping band most suitable to the object of the present invention, thermoplastic elastomers such as polyolefine elastomers, ethylene-propylene copolymer rubber, ethylene-vinyl acetate copolymers, syndiotactic-1, 2-polybutadiene, styrene-butadiene block copolymers, thermoplastic polyurethanes, polyester-polyether block copolymers, and the like were subjected to tests and extruded in a known manner to form respective strapping bands and physical properties thereof were investigated. It was found that the Young's modulus of the bands made of these thermoplastic elastomers were in a range of from 0.3 to 5 kg/mm$^2$, tensile strengths thereof were within 0.3 and 4 kg/mm$^2$, and the elongation rates thereof were in a range of from 1000 to 2000%.

For the production of the desired strapping band, the above mentioned Young's modulus and the tensile strength are too low, whereas the elongation rates thereof are too high.

However, it could be noted that when the elastomer extruded into a band-shape is cooled and solidified and then subjected to an elongation in the lengthwise direction, the Young's modulus as well as the tensile strength could be elevated and the elongation rate thereof could be reduced. By such treatment, it became possible to provide a strapping band having Young's modulus in a range of 10 to 50 kg/mm$^2$, tensile strength in a range of 4 to 15 kg/mm$^2$, elongation rate in a range of 40 to 500% with a good elasticity recovering rate.

Although the above thermoplastic elastomers came to have improved properties acceptable as the elastic strapping bands by the treatment set forth above, it could be found in the present invention that ethylene-vinyl acetate copolymers are the best elastomer in view of the workability at the time of extrusion as well as the plysical properties such as Young's modulus, tensile strength, elasticity recovering rate and the like. In addition, ethylene-vinyl acetate copolymers are the most economical from the viewpoint of production costs. For the reasons above, ethylene-vinyl acetate copolymers are selected for the material for producing the strapping band according to this invention.

The strapping band according to this invention may be made of any of the ethylene-vinyl acetate copolymers containing from 3 to 20 wt% of vinyl acetate, the molecules of which are oriented to the lengthwise direction of the band, the double refraction rate $\Delta n$ of which is in a range of from $24\times10^{-3}$ to $38\times10^{-3}$, and the tensile strength of which is higher than 3.3 kg/mm$^2$ at a room temperature. Furthermore, the band has a stress residual rate higher than 15% after it is extended under an initial load of 3.3 kg/mm$^2$, and an elasticity recovering rate higher than 70%.

Preferably, ethylene-vinyl acetate copolymer of the band contains vinyl acetate from 8 to 20wt% to provide a strapping band hardly splittable along its longitudinal direction.

Ethylene-vinyl acetate copolymer containing less than 3wt% of vinyl acetate exhibits a reduced residual stress under a highly oriented molecular arrangement, although the elasticity recovering rate thereof can be somewhat improved, and exhibits a reduced elasticity recovering rate under a less oriented molecular arrangement, although the residual stress thereof can be slightly improved. Accordingly, even if the molecular orientation be adjusted suitably, it is difficult to bring the residual stress as well as the elasticity recovering rate into their required ranges. This indicates that the ethylene-vinyl acetate copolymer containing less than 3wt% of vinyl acetate has an excessively great crystallization rate. When a band made of such copolymer is elevated in its molecular orientation, the Young's modulus is elevated remaining substantially no residual stress after the elongation under a comparatively low tensile load of 3.3 kg/mm$^2$. Conversely, when the band is reduced in its molecular orientation to thereby reduce the Young's modulus slightly, the elasticity recovering rate is reduced although its elongation is improved to elevate the residual stress in the band.

In the case where the content of the vinyl acetate exceeds 20%, the VICAT softening point of the copolymer is reduced lower than 60° C., which feature is not desirable in view of heat resistivity of the strapping band. Furthermore, the band made of such copolymer will have another drawback of increasing the stress relaxation effect.

From the above described reasons, the content of vinyl acetate in the ethylene-vinyl acetate copolymer employed in the present invention is selected in a range of from 3 to 20wt%.

Now, reference is made to the reason why the degree of molecular orientation in the present strapping band is limited to have a double refraction rate of from $24\times10^{-3}$ to $38\times10^{-3}$.

When the double refraction rate ($\Delta n$) is selected to be lower than the lower limit of $24\times10^{-3}$, the tensile strength of the strapping band becomes too low, and the elasticity recovering rate is also deteriorated. Conversely, when the double refraction rate ($\Delta n$) is selected to be higher than the upper limit of $38\times10^{-3}$, the Young's modulus becomes too high, and, as a result, the residual stress in the band becomes too low.

The double refraction rate ($\Delta n$) has been employed herein for determining numerically the degree of molecular orientation in the lengthwise direction of the strapping band. In the determination of the double refraction rate, the difference between the refractive indices for the light transmitted in the lengthwise direction of a specimen and for the light transmitted in the transverse direction of the specimen is measured.

In the practical measurement, a part of the specimen is cut off, and the thus cut part is fixed utilizing ethyl cellulose paraffin. The thus fixed part of the specimen is cut by a microtome in a direction parallel to the extended direction of the specimen to provide a thickness of approximately 25 microns. After the measurement of the thickness (d), a retardation (Γ) is measured through a white light source by a Berek compensator, and the double refraction rate (Δn) is calculated by the following formula:

$$\Delta n = \Gamma / d.$$

In the above described measurements of the thickness and the retardation, those showing excessive irregularities are omitted. The measurements of the retardation are carried out at three positions on each of three sliced pieces, and the values of the Δn are calculated respectively from these values. Finally, a mean value is calculated from these calculated values.

The physical properties of the strapping band at a room temperature are quantitatively described as follows. Tensile strength is more than 3.3 kg/mm$^2$, the tightening elasticity in terms of the stress residual rate is more than 15% after the band is elongated under application of 3.3 kg/mm$^2$ load and then contracted by 5%, and the elasticity recovering rate is more than 70% after the band is elongated under the 3.3 kg/mm$^2$ load.

The thickness of the strapping band according to this invention is ordinarily in a range of from 0.2 to 2 mm. A thickness less than 0.2 mm invites a difficulty in joining the band together during the binding operation. More specifically, when joining the band by heat fusion where only the surface part of the band is to be melted, the entire band tends to be deformed due to the insufficient thickness, thus lowering the strength. When the band is joined by use of metal clamp or the like, the insufficient thickness causes the band to slip out of the clamp easily. Conversely, a thickness of more than 2 mm of the band causes a difficulty in passing through a strapping machine or in the binding operation.

The band width is selected in a range of from 5 to 50 mm in consideration of the articles to be bound thereby, easiness in the binding operation, and economy requirement.

The measurements of the tensile strength, stress residual rate, elasticity recovering rate, heat resistivity, dispersing stress remaining rate, fusion joint strength, initial Young's modulus, and the tensile elongation described in this specification were carried out as follows.

The tensile strength and elongation were measured respectively at the time of breakdown of a specimen having a chuck-to-chuck length of 30 mm while it is elongated at a rate of 100 mm/min. The initial Young's modulus was calculated from the initial taper of a load-elongation curve plotted during the previous measurement. The stress residual rate was measured by elongating a specimen having a chuck-to-chuck length of 100 mm under an initial load of 3.3 kg/mm$^2$, thereafter contracting the specimen by a length corresponding to 5% of the elongated length, and measuring the rate of the stress remaining in the specimen to the initially applied load.

The elasticity recovering rate was measured and calculated as follows. A specimen having a chuck-to-chuck length of 100 mm was elongated under application of an initial load of 3.3 kg/mm$^2$, the first elongated length $\Delta l_1$ was measured, the specimen is then contracted until no stress remains therein, the second elongated length $\Delta l_2$ from the initial length was measured, and the elasticity recovering rate was calculated from the following formula.

$$\text{Elasticity recovering rate} = \frac{\Delta l_1 - \Delta l_2}{\Delta l_1} \times 100\ (\%)$$

The heat resistivity was evaluated by measuring VICAT softening point through ASTM D-1525 procedure.

The dispersing stress remaining rate was obtained by firstly elongating a specimen having a chuck-to-chuck length of 100 mm until 5 kg/mm$^2$ load (initial load $\sigma_0$) is indicated, leaving the specimen in this length and at 30° C. for one hour, measuring the remaining stress ($\sigma_1$) at that time, and calculating the same rate from the following formula.

$$\text{Dispersing stress remaining rate} = \frac{\sigma_1}{\sigma_0} \times 100\ (\%)$$

The fusion joint strength was obtained by partly fusing the surfaces of the band, to be heat-joined in an overlapping relation, by a heat plate held at a predetermined temperature, removing the heat plate, joining the surfaces under application of a compressive force, holding the thus prepared specimen between two chucks spaced apart by 100 mm with the joined part held at the middle part of the specimen, elongating the specimen at a rate of 100 mm/min, measuring the tensile strength at the joined part, and comparing the tensile strength with that of the band itself.

The method for producing the strapping band of this invention will now be described.

Ethylene-vinyl acetate copolymer containing vinyl acetate of 3 to 20wt% is melted in a screw type extruder at a temperature of 150° to 200° C., and then extruded through a slit-formed die having a gap of 0.35 to 3.5 mm and a width of 15 to 150 mm. The copolymer extruded into a band-shape is led into a water bath to be cooled and solidified, and then is subjected to an elongation process between rolls rotated at different speeds. According to the present invention, the elongation rate which determines the degree of the molecular orientation is 2.5 to 6.0. The elongation can be smoothly carried out at a temperature ranging from a room temperature to 50° C. When the elongation process is carried out between rolls rotated at different speeds, there is a tendency that the band once elongated shrinks to some extent.

In order to fix the molecular orientation in the band, the band once elongated is advantageously heat treated between rolls of substantially equal speeds at a temperature ranging from 50° to 80° C. while it is maintained at a constant length. In this way, the elongation rate of maximum 6.0 times can be maintained.

By the method described above, a strapping band of a generally rectangular cross-section having a thickness ranging from 0.2 to 2 mm and a width ranging from 5 to 50 mm can be extruded continuously and passed through the processes of cooling, elongation, and heat-fixing, until it is finally wound in a coil.

In the usage of the strapping band according to the present invention, the band is wound around an article or articles while applying a suitable tension imparting an elongation to the band. Thus, a tension stress for tightening the article can remain in the band for a long time after binding around the article or articles.

Although the band thus wound around the article or articles can be connected with each other by using clamping metal pieces, or by any other conventional method, it is preferably joined together by use of heat-fusing technique. More specifically, by bringing the surfaces of the end parts of the band into contact with a heating plate held at a temperature of 180° to 200° C., the surfaces to be joined together can be partially melted or softened. The surfaces are thereafter brought into contact in an overlapping relation, and pressed together under application of about 10 kg/cm$^2$ compressive force for about one second. It was found that the strength of the joined part of the binding band according to this invention was more than 80% of the strength of the band itself.

The invention will be further described in detail with reference to the following practical examples and tests.

Twenty-one strapping bands were produced as specimens for comparative tests. That is, high-pressure polyethylene named Ubepolyethylene (made by Ube Kosan Co.) and ethylene-vinyl acetate copolymers named Petrosen (made by Toyo Soda Co.) and Evaflex (made by Mitsui Polychemical Co.) each containing vinyl acetate in the range of from 0 to 28wt% were extruded respectively through a slit-shaped die having 1.0 mm gap and 48 mm width of a screw type extruder. The extruded bands were then cooled by water to be solidified, and were fed onto a first roll. The bands were then elongated respectively at various elongation rates between the first roll and a second roll while these were passed through a hot-water bath in a temperature range of from 40° to 50° C.

Some of the bands thus obtained were further subjected to heat treatments in elongated conditions or at constant lengths, between the second roll and the third roll, while the bands were passed respectively through another hot-water bath at a temperature in a range of from 30° to 80° C.

Table 1 below shows different conditions of the produced twenty-one strapping bands or specimens such as the materials, elongation rates, temperatures of the heat treatments, elongation rates during the heat treatments, widths and thicknesses of the resultant bands, and double refraction rates ($\Delta n$).

In Table 1, temperatures of the heat treatments carried out between the second roll and the third roll and elongation rates determined by the ratio between the rotating speeds of the two rolls are indicated in the column of the heat treatment. Since some of the elongated bands tend to shrink after passing through the two rolls, the values indicated under multiplication rate are not obtained from the rotating speed ratio of these rolls, but from denier ratio between the unelongated and elongated bands. This is also held true for the multiplication rates for the specimens subjected to elongation during the heat treatment. Physical properties measured for each specimen after above described treatments are indicated in Table 2.

Table 1

| | Raw Material | | Elongation | | | Resultant Band | | |
|---|---|---|---|---|---|---|---|---|
| | | | | Heat Treatment | | | | |
| No. of Specimens | Trade Name | Vinyl Acetate content (wt%) | Multiplication rate (times) | temperature(°C.) | elongation rate (times) | Width (mm) | Thickness (mm) | Molecular orientation $\Delta n \times 10^3$ |
| 1 | Ubepolyethylene | 0 | 3.2 | | | 16.2 | 0.50 | 29.8 |
| 2 | " | " | 5.3 | | | 15.8 | 0.40 | 39.7 |
| 3 | Petrosen | 3 | 2.5 | | | 18.8 | 0.48 | 24.9 |
| 4 | " | " | 3.8 | | | 16.8 | 0.56 | 32.4 |
| 5 | " | " | 5.7 | | | 15.3 | 0.46 | 39.3 |
| 6 | Evaflex | 8 | 4.5 | | | 16.5 | 0.60 | 34.7 |
| 7 | " | " | 5.8 | 69 | 1.0 | 15.7 | 0.55 | 39.0 |
| 8 | " | 14 | 1.0 | | | 16.6 | 1.15 | 0 |
| 9 | " | " | 1.9 | | | 11.9 | 0.80 | 15.8 |
| 10 | " | " | 3.35 | | | 17.1 | 0.62 | 27.6 |
| 11 | " | " | 4.5 | | | 16.5 | 0.65 | 28.5 |
| 12 | " | " | 5.8 | 30 | 1.3 | 14.6 | 0.55 | |
| 13 | " | " | 5.3 | 80 | 1.0 | 15.2 | 0.60 | 29.1 |
| 14 | " | " | 5.2 | 70 | 1.0 | 15.8 | 0.55 | |
| 15 | " | " | 5.8 | " | 1.2 | 14.5 | 0.58 | 27.0 |
| 16 | " | " | 6.4 | " | 1.3 | 13.8 | 0.55 | 31.9 |
| 17 | " | 19 | 4.7 | | | 17.0 | 0.60 | 27.1 |
| 18 | " | " | 4.0 | | | 16.8 | 0.50 | 26.0 |
| 19 | " | 25 | 4.2 | | | 18.1 | 0.53 | 18.2 |
| 20 | " | " | 5.1 | 67 | 1.0 | 16.2 | 0.48 | |
| 21 | " | 28 | 4.4 | | | 19.1 | 0.65 | |

Table 2

| No. of Specimens | Tensile Strength (kg/mm²) | Ultimate Elongation (%) | Initial Young 's modulus (kg/mm²) | After elongation under 3.3kg/mm² load: remaining stress after 5% contraction (%) | After elongation under 3.3kg/mm² load: elasticity recovering rate (%) | VICAT Soften temperature (°C.) | Dispersing stress remaining rate (%) |
|---|---|---|---|---|---|---|---|
| 1 | 3.8 | 301 | 25 | 36 | 38 | 90 | |
| 2 | 6.5 | 52 | 49 | 3 | 88 | " | 61 |
| 3 | 3.6 | 178 | 14 | 45 | 74 | 92 | |
| 4 | 5.3 | 46 | 35 | 40 | 82 | " | |
| 5 | 8.1 | 39 | 58 | 0 | 88 | " | 79 |
| 6 | 5.5 | 69 | 31 | 38 | 89 | 74 | |
| 7 | 8.3 | 48 | 37 | 8 | 94 | " | 75.5 |
| 8 | 1.5 | 1140 | 3 | broken during elongation | | 68 | |
| 9 | 2.4 | 317 | 5.5 | broken during elongation | | | |
| 10 | 4.3 | 157 | 14 | 45 | 78 | " | |
| 11 | 6.1 | 90 | 22.5 | 42 | 82 | " | 61 |
| 12 | 10.2 | 64 | 36 | 38 | 85 | " | 63 |
| 13 | 6.5 | 86 | 19 | 35 | 81 | " | 64 |
| 14 | 6.9 | 64 | 19.5 | | | " | 68 |
| 15 | 8.8 | 57 | 26 | 35 | 86 | " | 71 |
| 16 | 10.3 | 49 | 31 | 38 | 85 | " | 71 |
| 17 | 8.1 | 83 | 25 | 42 | 80 | 64 | 61.5 |
| 18 | 6.1 | 120 | 19 | 43 | 75 | 64 | 60.0 |
| 19 | 5.9 | 114 | 9 | 32 | 67 | 54 | *1 58 |
| 20 | 7.1 | 106 | 7 | 27 | 78 | " | *1 59 |
| 21 | 4.4 | 153 | 6 | 32 | 61 | 42 | *2 53 |

*1 measured under initial load of 5kg/mm² at 23° C.
*2 measured under initial load of 3.3kg/mm² at 23° C.

As will be apparent from Table 1 and also FIG. 1 showing a relation between elongation multiplication rate and double refraction rate in various specimens containing different amounts of vinyl acetate, i.e. 0%, 3%, 8%, 14%, 19% and 25% of vinyl acetate, the molecular orientation sharply increases in accordance with an increase in the elongation multiplication rate until this multiplication rate becomes three times, and thereafter, the molecular orientation increase mildly. On the other hand, when the variation of the molecular orientation is compared between specimens having substantially equal elongation multiplication rates, it is found that a higher molecular orientation can be obtained in specimen having smaller content of vinyl acetate.

Figure 2:
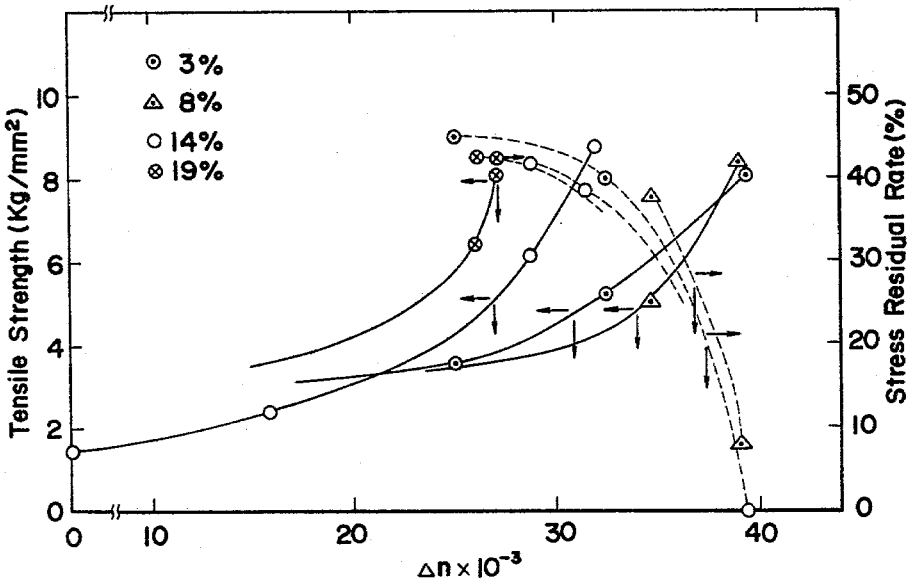
FIG. 2 is a graphical representation showing relations between double refracting rate, tensile strength, and stress residual rate of the bands made of the above-mentioned copolymer containing different amounts of vinyl acetate.

Observing the relation between the elongation multiplication rate and the physical properties of the bands from Tables 1 and 2, initial Young's modulus and tensile strength of the band increase in accordance with an increase in the elongation multiplication rate, while ulitimate elongation of the band decreases. Furthermore, in accordance with the increase in the double refraction rate ($\Delta n$), the tensile strength increases while the stress residual rate decreases. In FIG. 2, it is shown how the tensile strength and the stress residual rate vary in accordance with variation in the double refracting rate for specimens containing different amounts of vinyl acetate, i.e. 3%, 8%, 14% and 19% of vinyl acetate. When the double refraction rate ($\Delta n$) exceeds $24\times10^{-3}$, the tensile strength increases abruptly, and when it exceeds $38\times10^{-3}$, the stress residual rate vanishes in a short period. On the other hand, when the double refraction rate ($\Delta n$) is lower than $24\times10^{-3}$, the tensile strength is reduced lower than 3.3 kg/mm² which is not sufficient as strapping band. Conversely, when the double refraction rate ($\Delta n$) is higher than $38\times10^{-3}$, the residual stress is reduced below 15% thereby exhibiting too small elastic binding force. For this reason, it is essential that the present band has double refraction rate in the range of from $24\times10^{-3}$ to $38\times10^{-3}$.

For restricting the double refraction rate within the above described range, it is apparent from FIG. 1 that, in the production process of the strapping band, the elongation multiplication rate must be limited between 2.5 to 6, although these values might be slightly changed in accordance with the content of vinyl acetate.

Figure 3:
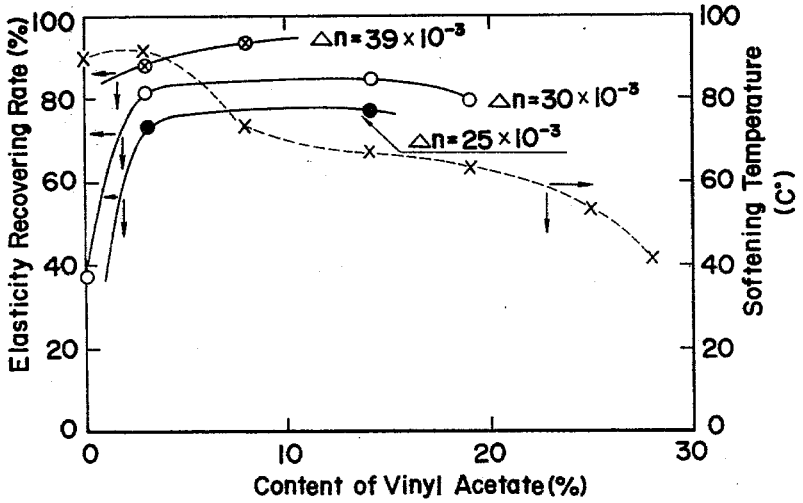
FIG. 3 is a graphical representation showing relations between the content of vinyl acetate, elasticity recovering rate, and softening temperature of the bands having different double refraction rate.

As it could be noted from the relation between the content of vinyl acetate and physical properties of bands indicated in Tables 1 and 2, there exists a tendency that the softening temperature and the residual stress are both reduced in accordance with an increase in the content of vinyl acetate. In FIG. 3, there are indicated relations between the content of vinyl acetate, elasticity recovering rate, and the softening temperature of specimens having different molecular orientation. As will be apparent from FIG. 3, in a range where the content of vinyl acetate is less than 3% and the double refraction rate $\Delta n$ is lower than $30\times10^{-3}$, the elasticity recovering rate is much deteriorated. Although the elasticity recovering rate can be improved by elevating the molecular orientation rate to $39\times10^{-3}$, the stress residual rate becomes too low as indicated for No. 2 specimen in Table 2. Accordingly, more than 3% of vinyl acetate must be contained in the copolymer.

On the other hand, the specimens containing more than 20% of vinyl acetate have a softening temperature below 60° C., and the residual stress of the specimens will be reduced lower than the practically allowable value as shown in Table 2. Thus it is apparent that vinyl acetate from 3 to 20% must be contained in the ethylene-vinyl acetate copolymer.

In Table 3, there are indicated evaluation results of the longitudinal splits of specimens having various content of vinyl acetate and various extent of molecular orientation. In the evaluation of the longitudinal splits, a band is cut into 20 mm length along the elongated direction, and the thus cut piece is folded into two parts along the elongated direction under application of bending forces in perpendicular to the elongated direction. In the evaluation of the longitudinal splits, a specimen in which a longitudinal crack appears along the entire 20 mm length of folding line is indicated by x mark, a specimen having a partial crack along the same line is indicated by Δmark, and a specimen having utterly no crack is indicated by o mark.

Table 3

| No. of Specimens | Vinyl Acetate Content (%) | Molecular Orientation rate ($n \times 10^3$) | Evaluation of longitudinal splits |
|---|---|---|---|
| 1 | 0 | 29.8 | x |
| 2 | 0 | 39.7 | x |
| 5 | 3 | 39.3 | x |
| 6 | 8 | 34.7 | Δ |
| 7 | 8 | 39.0 | Δ |
| 10 | 14 | 27.6 | o |
| 13 | 14 | 29.1 | o |
| 16 | 14 | 31.9 | o |
| 19 | 25 | 18.2 | o |

As will be apparent from Table 3, longitudinal splits are exhibited on those bands having lower content of vinyl acetate, while no such split is exhibited on those bands having a content of vinyl acetate exceeding 8%, and preferably higher than 14%.

In view of the test results shown in FIG. 3 and Table 3, the most preferable content of vinyl acetate is in a range of from 8 to 20 wt%.

Physical properties of the strapping band according to this invention were compared with those of a conventional polypropylene band. More specifically, No. 11 specimen was compared with a polypropylene band of "Danband" (Trade name of a band made by Ube Nitto Kasei Co. which has 15.5 mm width and 42,600 denier), and the results were shown in Table 4.

Although the tensile strength of the polypropylene band was higher than that of the specimen No. 11, the initial Young's modulus of the polypropylene band was excessively high, and no residual stress was found after the band was elongated under 3.3 kg/mm² load and then contracted by 5%. Although a slight residual stress was exhibited when the load applied to the band was elevated up to 16.4 kg/mm², the elasticity recovering rate of the polypropylene band was poor. On the other hand the specimen of this invention exhibited a sufficient residual stress at the time of 5% contraction after elongation under a low load, and the elasticity recovering rate at the time was also good.

Table 4

| Name of Specimens | Tensile Strength (kg/mm²) | Ultimate elongation (%) | Initial Young's modulus (kg/mm²) | After elongation under 3.3kg/mm² load: Residual stress after contraction of 5% (%) | After elongation under 3.3kg/mm² load: Elasticity recovering rate (%) | After elongation under 16.4kg/mm² load: Residual stress after contraction of 5% (%) | After elongation under 16.4kg/mm² load: Elasticity recovering rate (%) |
|---|---|---|---|---|---|---|---|
| Band of the Present Invention | 6.1 | 90 | 22.5 | 42 | 82 | — | — |
| Polypropylene Band | 28.8 | 23 | 310 | 0 | 100 | 7 | 52 |

The strength at the heat joined part of the present strapping band was measured. The band tested was of 14% vinyl acetate content, molecular orientation (Δn) of $30 \times 10^{-3}$, 15.8 mm width and 0.55 mm thickness, tensile strength was 60 kg, elongation was 64%, and initial Young's modulus was 20 kg/mm².

This specimen was joined as follows. Both end parts of the specimen to be joined in an overlapping relation were held spaced by approximately 5 mm, and a heat plate of 35 mm width having a constant temperature was inserted transversely between the spaced end parts of the specimen in parallel with the surfaces of the end parts. The end parts were then depressed toward the heat plate for a predetermined period (primary depression) for partly melting the surfaces. After the removal of the heating plate, the end parts of the specimen were again depressed (second depression) from both sides so that the partly melted internal surfaces of the end parts were heat fused between each other. Shown in Table 5 are the temperature of the heat plate, depressing forces applied at that time, the depressing period, a tensile strength obtained at the joined part, and the ratio of the tensile strength at the joined part to that of the band itself.

Under an optimum condition, the tensile strength at the joined part could be more than 90% of that of the band itself.

Table 5

| Temperature of heat plate (°C.) | Depressing force (kg/cm²) | Primary depressing period (Second) | Secondary depressing period (Second) | Tensile strength (kg) | Strength maintaing ratio (%) |
|---|---|---|---|---|---|
| 140 | 10 | 1.9 | 1.4 | 46 | 76 |
| 180 | 10 | 1.0 | 2.9 | 56 | 94 |
| " | " | 0.5 | 1.8 | 49 | 82 |
| 200 | " | 1.1 | 1.3 | 57 | 94 |
| " | 7 | 0.8 | 0.3 | 54 | 90 |

Table 5-continued

| Temperature of heat plate (°C.) | Depressing force (kg/cm²) | Primary depressing period (Second) | Secondary depressing period (Second) | Tensile strength (kg) | Strength maintaing ratio (%) |
|---|---|---|---|---|---|
| " | 3.6 | 0.7 | 0.2 | 43 | 71 |

The specimens under No. 12 and No. 15 in the table 1 and 2 were held into a chuck-to-chuck length of 100 mm and elongated under application of 5 kg/mm² load. While the specimens were held at the constant load, dispersion of the remaining stress was observed at 30° C. for one hour. The test results were indicated in FIG. 4. From the comparison between the two specimens, it was found that one of the specimens (No. 15 specimen) which had been subjected to a heat treatment after elongation exhibited lower dispersion of the remaining stress.

Figure 4:
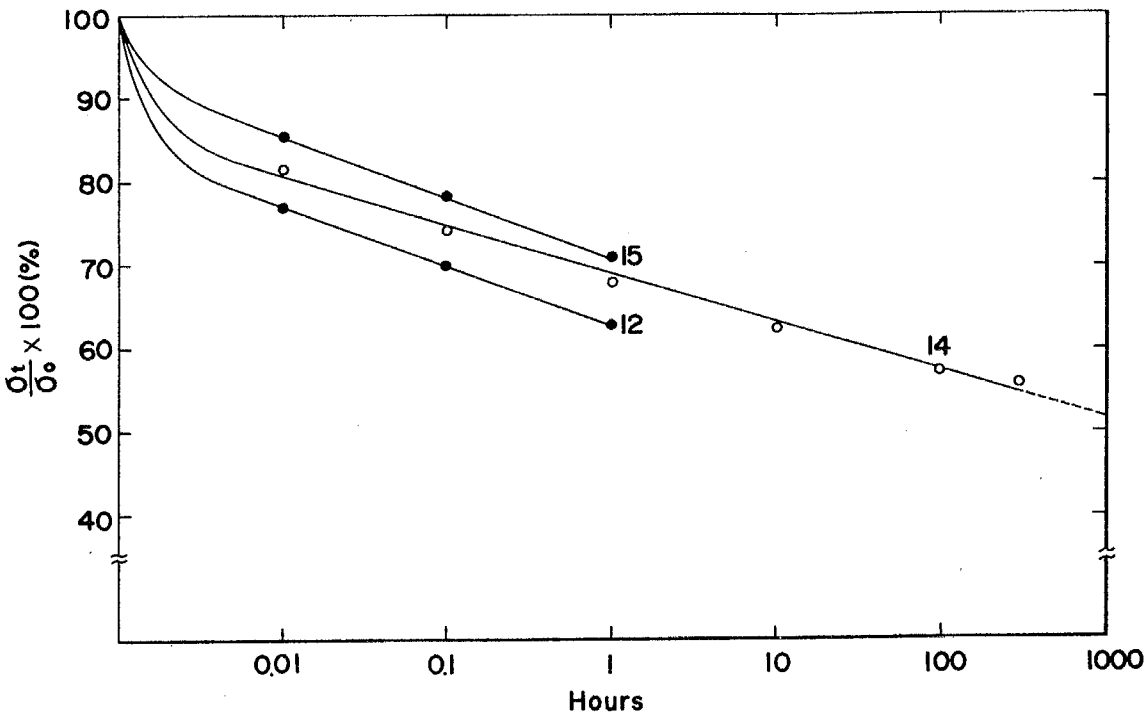
FIG. 4 is a graphical representation showing the reduction of the stress residual rate in accordance with the variation of the measured time.

Also in FIG. 4, there is shown a test result for the No. 14 specimen in Example 1. That is, the No. 14 specimen which had been heat treated after elongation was subjected to test to measure the dispersion of the remaining stress under an initial load of 4.8 kg/mm², at 30° C., for 300 hours. In view of a linear relation between the logarithm of the dispersion time and the stress remaining rate, this relation is extrapolated to 1000 hours, and is made apparent that a stress more than 50% of the initial load can be retained after 1000 hours.

In FIG. 4, the logarithm of the dispersion time is taken along the abscissa and the remaining stress calculated from the following formula is taken along the oridinate axis.

$$\text{Stress remaining rate} = (\sigma_t/\sigma_o) \times 100\ (\%)$$

Wherein $\sigma_o$ is the initial stress, and $\sigma_t$ is a stress remaining after a period t.

It should be noted that the figures designating curves in FIG. 4 correspond to specimen numbers used in table 1 and 2.

Although the present invention has been described with reference to the specific examples and specimens, many modifications and alterations may be made within the spirit of the present invention.

What is claimed is:

1. An elastic strapping band produced by extruding molten ethylene-vinyl acetate copolymer containing vinyl acetate in a range of 3 to 20 wt% into a band-shape, cooling and then subjecting the band-shaped copolymer to an elongation in a multiplication range of 2.5 to 6 times the initial length thereof, wherein said band has molecular orientation in the lengthwise direction thereof with a double refraction rate, $\Delta n$, being in the range of $24 \times 10^{-3}$ to $38 \times 10^{-3}$, whereby said band has a tensile strength higher than 3.3 kg/mm², and an elasticity recovering rate higher than 70%.

2. An elastic strapping band as claimed in claim 1, wherein the content of vinyl acetate in said ethylene-vinyl acetate copolymer is in the range from 8 to 20 wt%.

* * * * *